US007401952B2

(12) United States Patent
Lee

(10) Patent No.: US 7,401,952 B2
(45) Date of Patent: Jul. 22, 2008

(54) FOLDABLE LAMP SHADE ASSEMBLED AND DISASSEMBLED EASILY AND QUICKLY

(76) Inventor: Ting-Sheng Lee, 278, Side Rd., Wufeng Hsiang, Taichung Hsien (TW)

( * ) Notice: Subject to any disclaimer, the term of this patent is extended or adjusted under 35 U.S.C. 154(b) by 86 days.

(21) Appl. No.: 11/399,259

(22) Filed: Apr. 6, 2006

(65) Prior Publication Data

US 2007/0236943 A1 Oct. 11, 2007

(51) Int. Cl.
*F21V 17/00* (2006.01)

(52) U.S. Cl. ..... 362/450; 362/351; 362/352; 362/358; 362/357

(58) Field of Classification Search ..... 362/351, 362/352, 354, 355, 356, 357, 361, 410, 430, 362/450, 358; 24/293–295
See application file for complete search history.

(56) References Cited

U.S. PATENT DOCUMENTS 3,435,205 A * 3/1969 Paul ..... 362/352
4,605,996 A * 8/1986 Payne ..... 362/352
6,582,107 B2 * 6/2003 Tsai ..... 362/450
6,869,207 B2 3/2005 Lee ..... 362/352
2003/0142498 A1 * 7/2003 Lu ..... 362/352
2003/0198053 A1 * 10/2003 Lu ..... 362/352
2006/0109659 A1 * 5/2006 Lu ..... 362/352

FOREIGN PATENT DOCUMENTS

WO WO 8901113 A1 * 2/1989

* cited by examiner

*Primary Examiner*—Hargobind S. Sawhney
*Assistant Examiner*—Kevin J. Spinella
(74) *Attorney, Agent, or Firm*—Alan Kamrath; Kamrath & Associates PA

(57) ABSTRACT

A foldable lamp shade includes a shade body, an upper support ring, a plurality of locking members, a lower support ring, a plurality of hanging hooks, and a plurality of support bars. Thus, the user only needs to hook the hook hole of each of the support bars on the respective hanging hook and to insert the insertion portion of each of the support bars into the locking slot of the respective locking member so as to mount the support bars between the upper support ring and the lower support ring by the respective hanging hook and the respective locking member so that the lamp shade is assembled easily and quickly, thereby facilitating the user assembling the lamp shade.

16 Claims, 12 Drawing Sheets

FOLDABLE LAMP SHADE ASSEMBLED AND DISASSEMBLED EASILY AND QUICKLY

BACKGROUND OF THE INVENTION

1. Field of the Invention

The present invention relates to a lamp shade and, more particularly, to a foldable lamp shade.

2. Description of the Related Art

A conventional foldable lamp shade in accordance with the prior art shown in FIG. 12 comprises a shade body (not shown), an upper support ring 40 and a lower support ring 41 mounted on the shade body respectively and each provided with a plurality of locking protrusions 42, and a plurality of support bars 50 each mounted between the upper support ring 40 and the lower support ring 42 and each having two ends 52 each secured to the respective locking protrusion 42. Thus, each of the support bars 50 is located between the upper support ring 40 and the lower support ring 42 by the respective locking protrusion 42 to support the shade body.

The closest prior art reference of which the applicant is aware was disclosed in his U.S. Pat. No. 6,869,207B2.

BRIEF SUMMARY OF THE INVENTION

In accordance with the present invention, there is provided a lamp shade, comprising a shade body, an upper support ring mounted on an upper portion of the shade body, a plurality of locking members each having a first end mounted on the upper support ring and a second end formed with a locking slot, a lower support ring mounted on a lower portion of the shade body, a plurality of hanging hooks each mounted on the lower support ring, and a plurality of support bars each mounted between the upper support ring and the lower support ring and each having a first end formed with an insertion portion inserted into and locked in the locking slot of a respective one of the locking members and a second end hooked on a respective one of the hanging hooks.

The primary objective of the present invention is to provide a foldable lamp shade that is assembled and disassembled easily and quickly, thereby facilitating a user assembling and disassembling the lamp shade.

Another objective of the present invention is to provide a lamp shade, wherein the hook hole of each of the support bars is hooked on the respective hanging hook, and the insertion portion of each of the support bars is inserted into the locking slot of the respective locking member so that each of the support bars is located between the upper support ring and the lower support ring by the respective hanging hook and the respective locking member to support the shade body.

A further objective of the present invention is to provide a lamp shade, wherein the user only needs to hook the hook hole of each of the support bars on the respective hanging hook and to insert the insertion portion of each of the support bars into the locking slot of the respective locking member so as to mount the support bars so that the lamp shade is assembled easily and quickly, thereby facilitating the user assembling the lamp shade.

A further objective of the present invention is to provide a lamp shade, wherein the lamp shade is foldable before assembly to reduce the whole volume of the lamp shade efficiently, thereby facilitating storage, packaging and transportation of the lamp shade.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
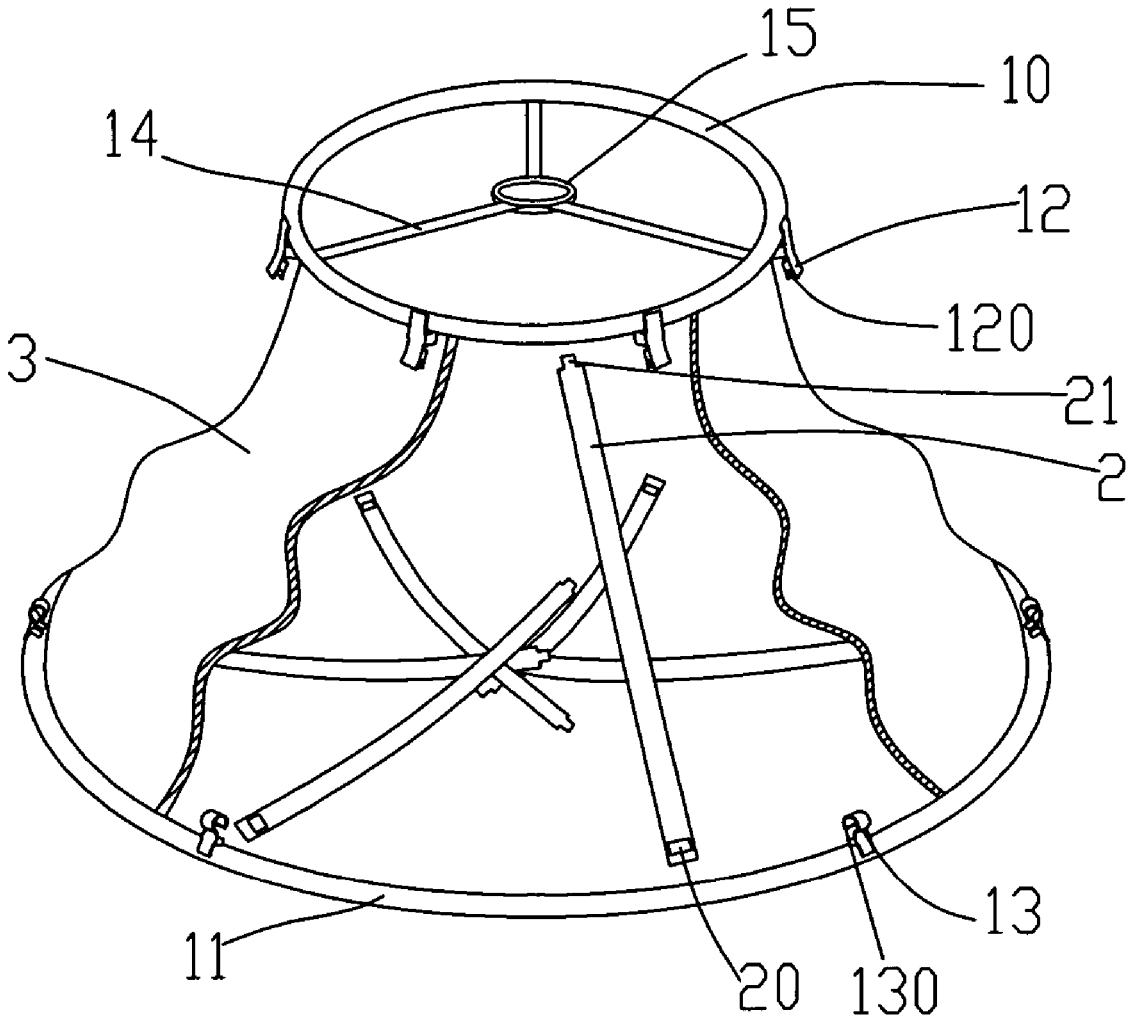
FIG. 1 is a partially perspective cross-sectional view of a lamp shade in accordance with the preferred embodiment of the present invention.
Figure 2:
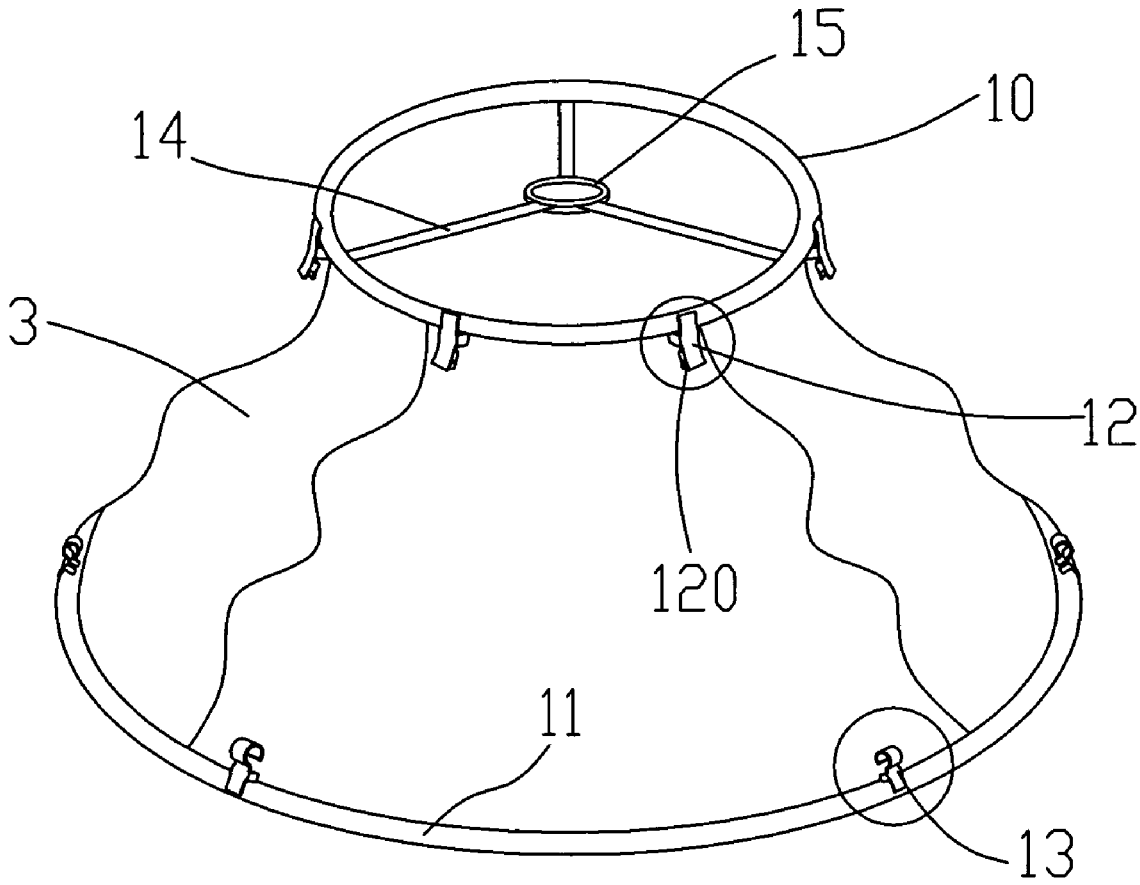
FIG. 2 is a partially perspective view of the lamp shade as shown in FIG. 1.
Figure 3:
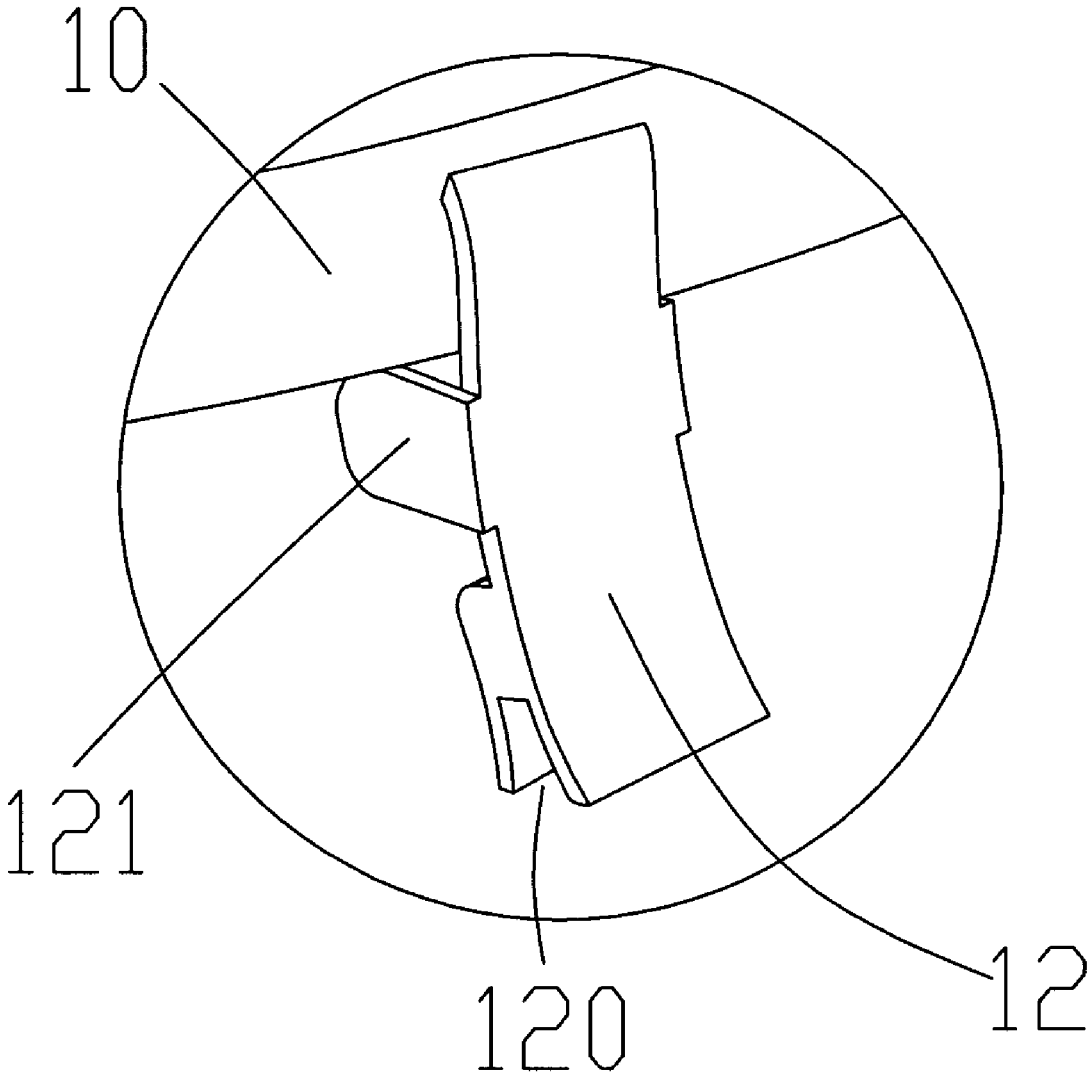
FIG. 3 is a locally enlarged view of the lamp shade as shown in FIG. 2.

Referring to the drawings and initially to FIGS. 1-3, a foldable lamp shade in accordance with the preferred embodiment of the present invention comprises a shade body 3, an upper support ring 10 mounted on an upper portion of the shade body 3, a plurality of locking members 12 each having a first end mounted on the upper support ring 10 and a second end formed with a locking slot 120, a lower support ring 11 mounted on a lower portion of the shade body 3, a plurality of hanging hooks 13 each mounted on the lower support ring 11, and a plurality of support bars 2 each mounted between the upper support ring 10 and the lower support ring 11 and each having a first end formed with an insertion portion 21 inserted into and locked in the locking slot 120 of a respective one of the locking members 12 and a second end hooked on a respective one of the hanging hooks 13.

The shade body 3 is made of a flexible material.

An inner ring 15 is located in the upper support ring 10 and connected to the upper support ring 10 by a plurality of support rods 14.

Each of the locking members 12 has a mediate portion formed with two outwardly extending resting plates 121 rested on a rim of the upper support ring 10.

Figure 4:
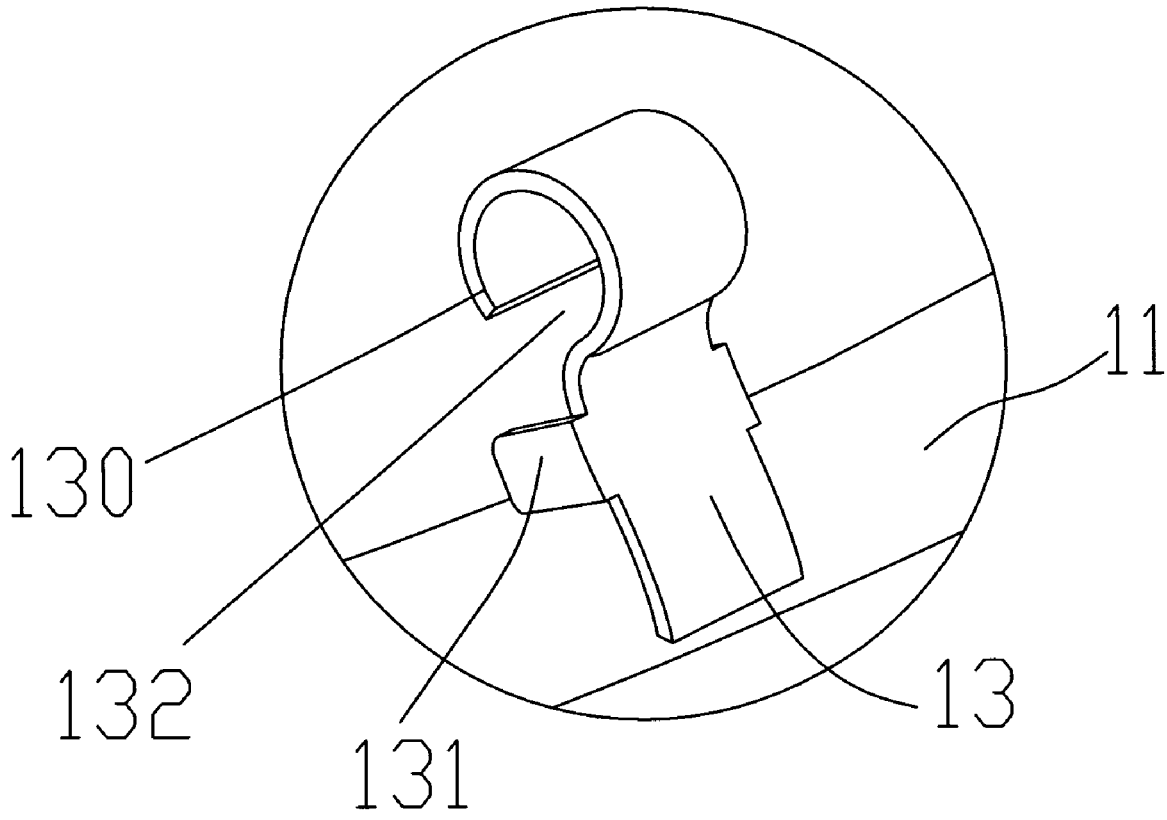
FIG. 4 is a locally enlarged view of the lamp shade as shown in FIG. 2.

Each of the hanging hooks 13 has an opening 132 (see FIG. 4) directed toward an inside of the lower support ring 11. Each of the hanging hooks 13 has a first end mounted on the lower support ring 11 and a second end formed with a bendable portion 130. Each of the hanging hooks 13 has a mediate portion formed with two outwardly extending resting plates 131 rested on a rim of the lower support ring 11.

The insertion portion 21 of each of the support bars 2 is slidably inserted into the locking slot 120 of the respective locking member 12. The insertion portion 21 of each of the support bars 2 has a width smaller than that of the first end of each of the support bars 2 to facilitate insertion of the insertion portion 21 of each of the support bars 2 into the locking slot 120 of the respective locking member 12.

The second end of each of the support bars 2 is formed with a hook hole 20 hooked on the respective hanging hook 13. The hook hole 20 of each of the support bars 2 has a width greater than that of the respective hanging hook 13. Preferable, the hook hole 20 of each of the support bars 2 is hooked on the bendable portion 130 of the respective hanging hook 13. Thus, after the hook hole 20 of each of the support bars 2 is hooked on the bendable portion 130 of the respective hanging hook 13, the bendable portion 130 of the respective hanging hook 13 is bendable to close the opening 132 to secure the second end of each of the support bars 2 to the respective hanging hook 13.

Figure 5:
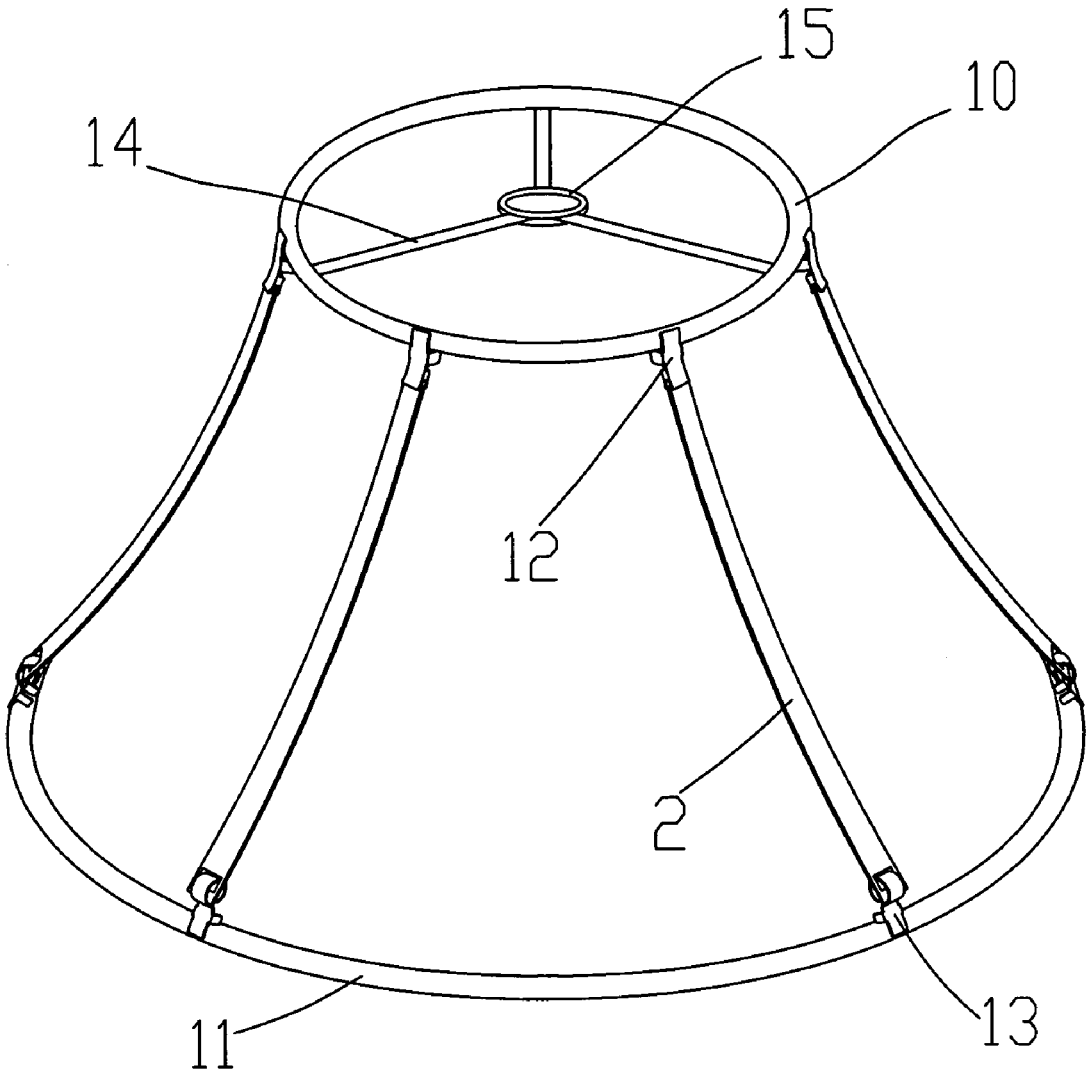
FIG. 5 is a partially perspective view of the lamp shade as shown in FIG. 1.
Figure 6:
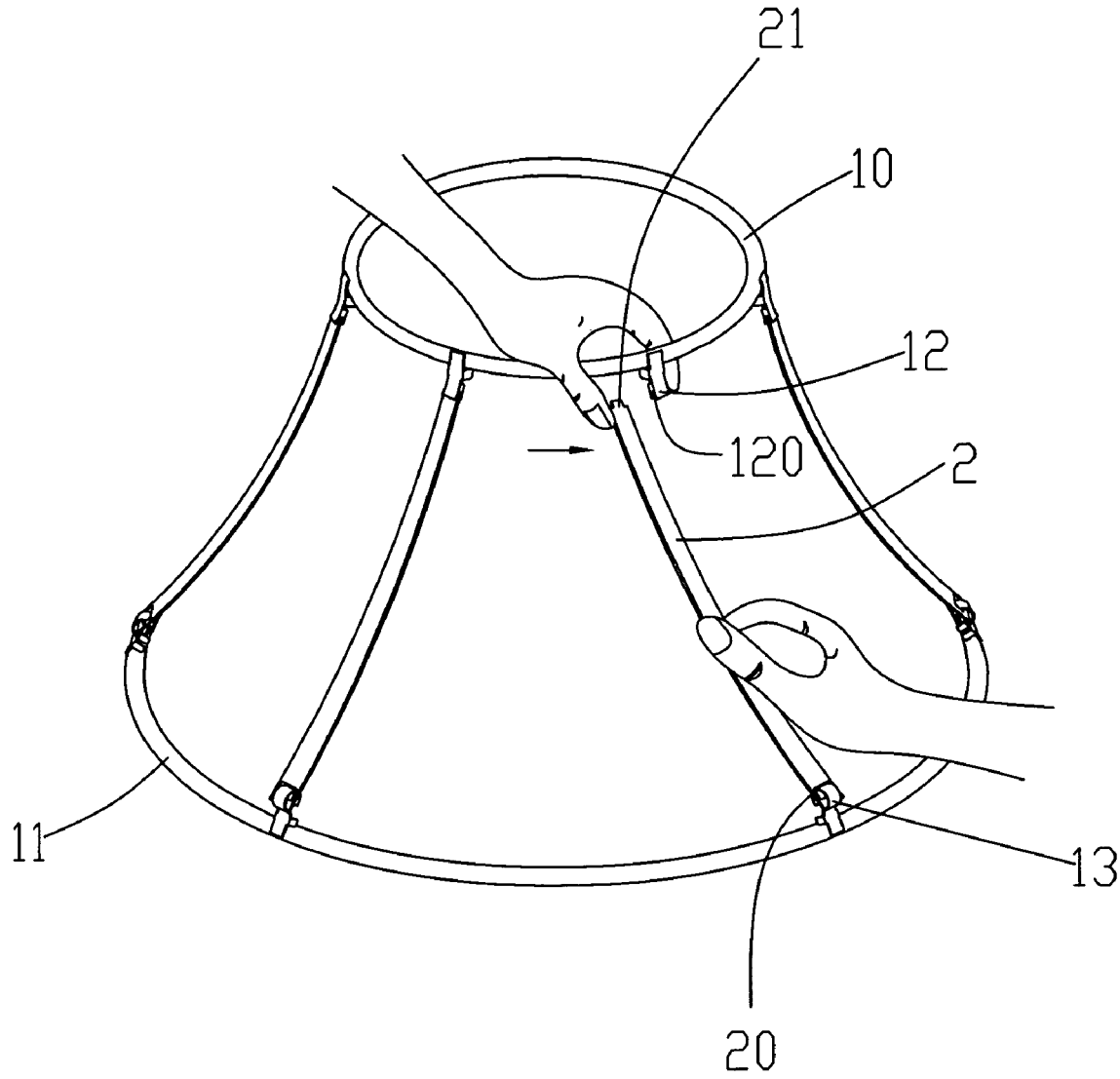
FIG. 6 is a perspective operational view of the lamp shade as shown in FIG. 5.
Figure 7:
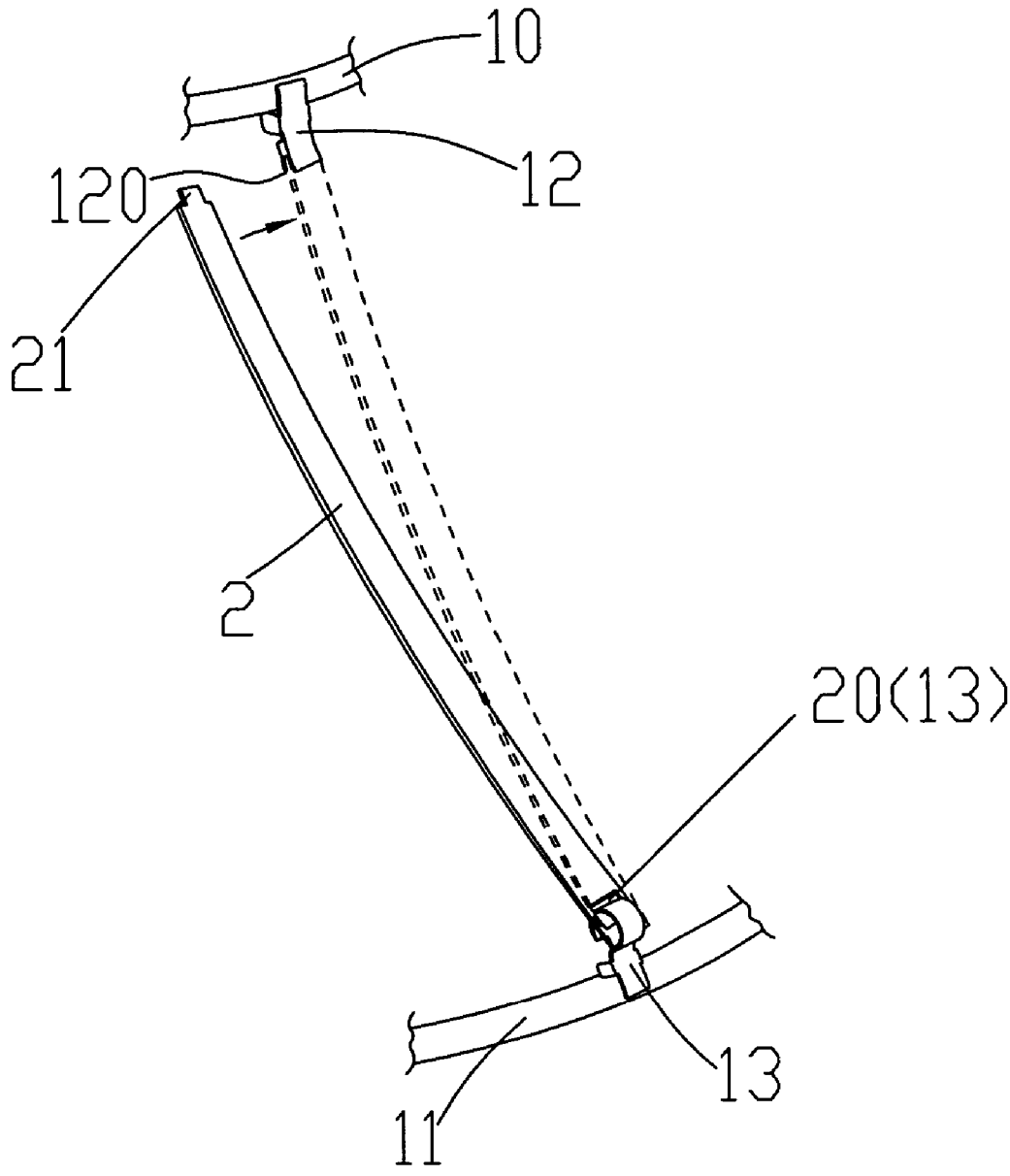
FIG. 7 is a schematic operational view of the lamp shade as shown in FIG. 6.
Figure 8:
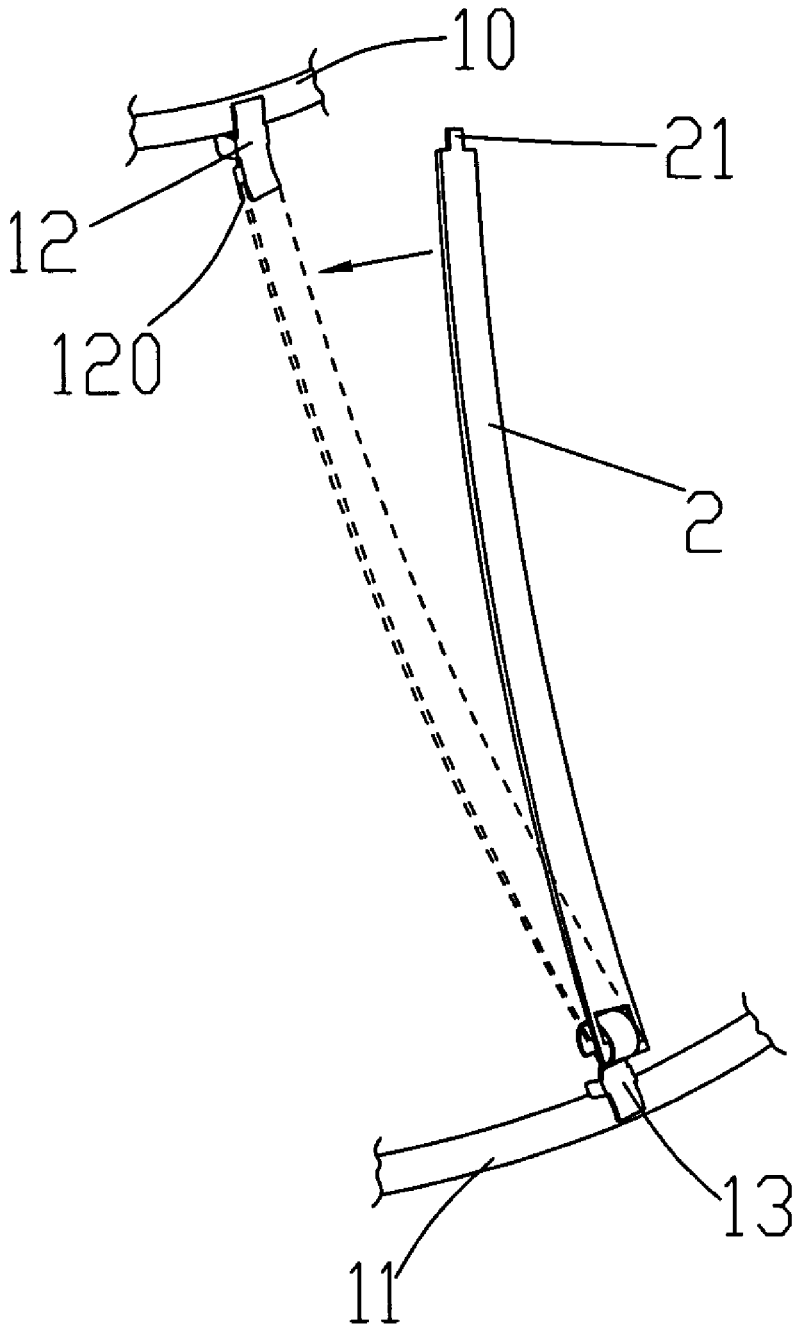
FIG. 8 is a schematic operational view of the lamp shade as shown in FIG. 6.

In operation, referring to FIGS. 6-8, the hook hole 20 of each of the support bars 2 is initially hooked on the respective hanging hook 13. Then, the insertion portion 21 of each of the support bars 2 is sideward slidable into the locking slot 120 of the respective locking member 12 as shown in FIG. 7 or 8 so that each of the support bars 2 is located between the upper support ring 10 and the lower support ring 11 by the respective hanging hook 13 and the respective locking member 12 as shown in FIG. 5 to support the shade body 3.

Figure 9:
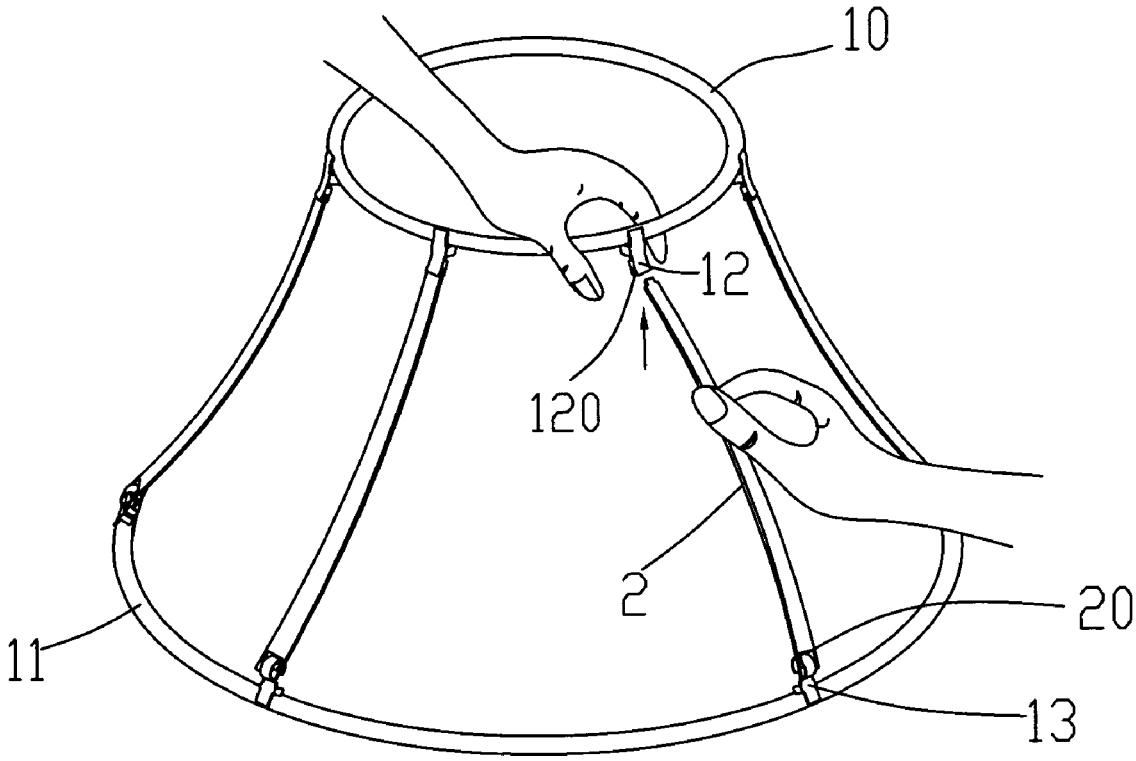
FIG. 9 is a perspective operational view of the lamp shade as shown in FIG. 5.
Figure 10:
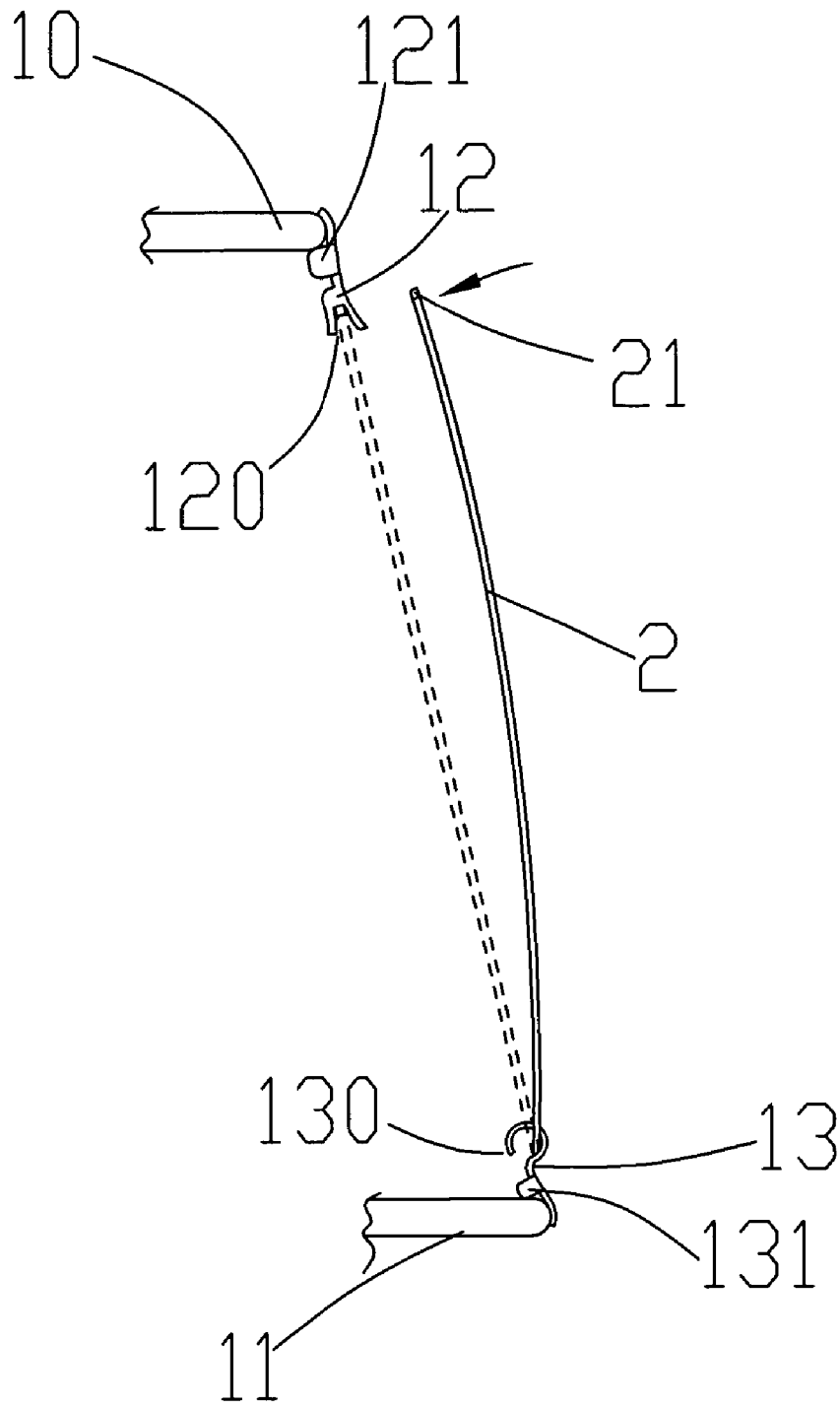
FIG. 10 is a schematic operational view of the lamp shade as shown in FIG. 9.
Figure 11:
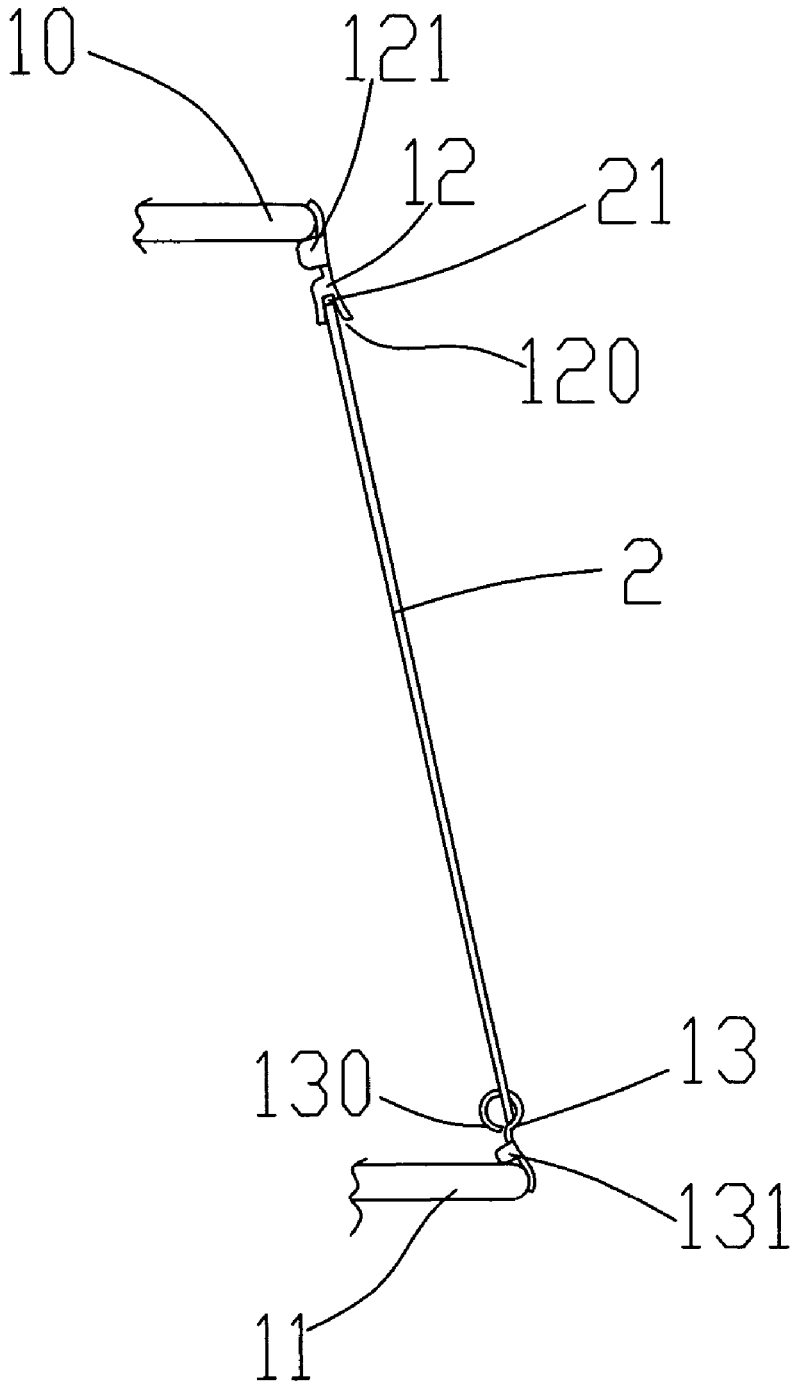
FIG. 11 is a schematic operational view of the lamp shade as shown in FIG. 10.
Figure 12:
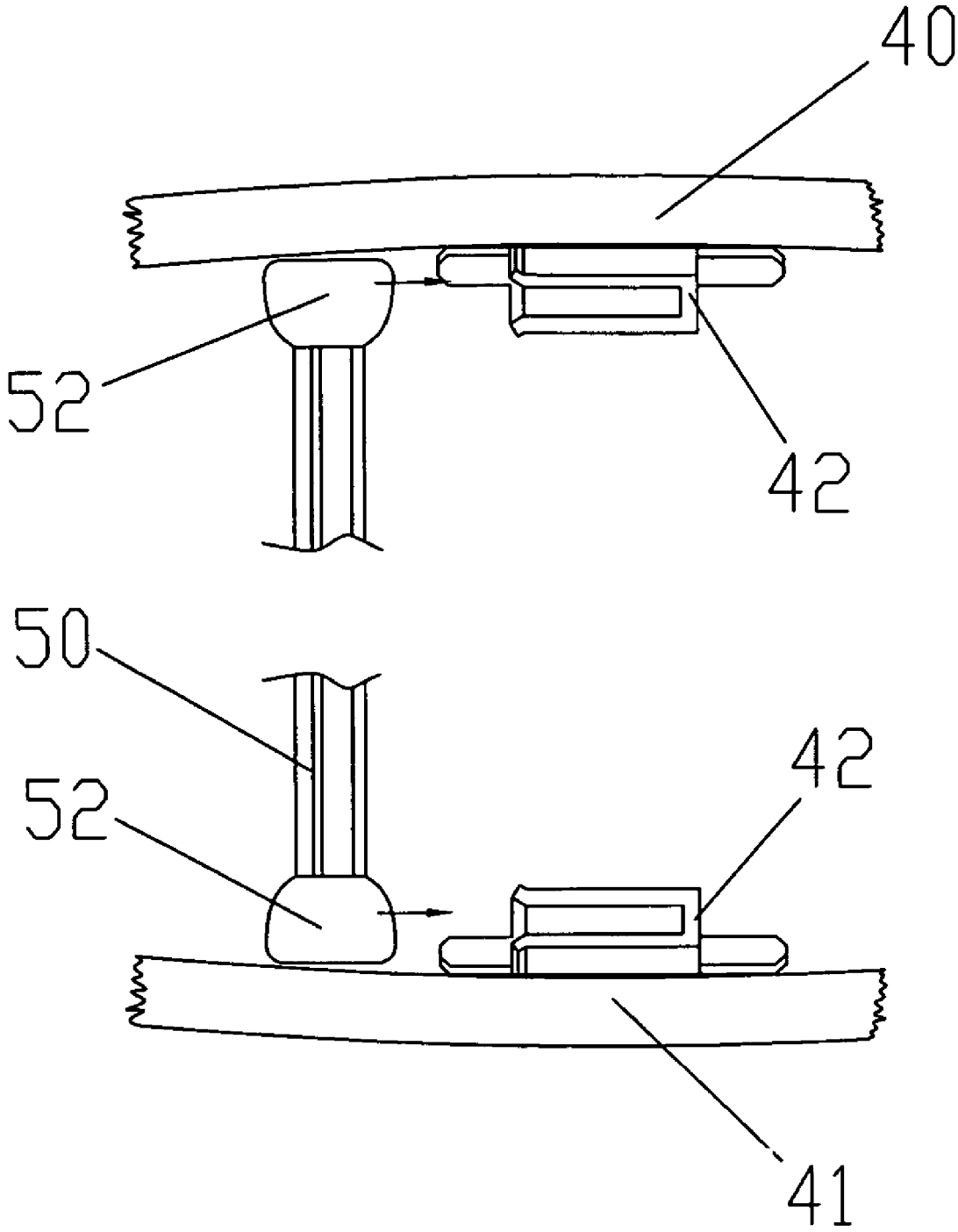
FIG. 12 is a partially plan exploded view of a conventional lamp shade in accordance with the prior art.

Alternatively, referring to FIGS. 9-11, the hook hole 20 of each of the support bars 2 is initially hooked on the respective hanging hook 13. Then, each of the support bars 2 is slightly bent as shown in FIG. 10 so that the insertion portion 21 of each of the support bars 2 is inserted into the locking slot 120 of the respective locking member 12 as shown in FIG. 11. Thus, each of the support bars 2 is located between the upper support ring 10 and the lower support ring 11 by the respective hanging hook 13 and the respective locking member 12 as shown in FIG. 5 to support the shade body 3.

Accordingly, the hook hole 20 of each of the support bars 2 is hooked on the respective hanging hook 13, and the insertion portion 21 of each of the support bars 2 is inserted into the locking slot 120 of the respective locking member 12 so that each of the support bars 2 is located between the upper support ring 10 and the lower support ring 11 by the respective hanging hook 13 and the respective locking member 12 to support the shade body 3. In addition, the user only needs to hook the hook hole 20 of each of the support bars 2 on the respective hanging hook 13 and to insert the insertion portion 21 of each of the support bars 2 into the locking slot 120 of the respective locking member 12 so as to mount the support bars 2 so that the lamp shade is assembled easily and quickly, thereby facilitating the user assembling the lamp shade. Further, the lamp shade is foldable before assembly to reduce the whole volume of the lamp shade efficiently, thereby facilitating storage, packaging and transportation of the lamp shade.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A lamp shade, comprising:

a shade body;

an upper support ring mounted on an upper portion of the shade body;

a plurality of locking members each having a first end mounted on the upper support ring and a second end formed with a locking slot;

a lower support ring mounted on a lower portion of the shade body;

a plurality of hanging hooks each mounted on the lower support ring;

a plurality of support bars each mounted between the upper support ring and the lower support ring and each having a first end formed with an insertion portion inserted into and locked in the locking slot of a respective one of the locking members and a second end hooked on a respective one of the hanging hooks;

wherein the locking slot of each of the locking members has a substantially inverted U-shaped cross-sectional profile and has an opening directed downward;

the second end of each of the support bars is formed with a hook hole hooked on the respective hanging hook;

each of the hanging hooks has a first end mounted on the lower support ring and a second end formed with a bendable portion;

each of the hanging hooks has a mediate portion formed with two outwardly extending resting plates located between the first end and the second end of each of the hanging hooks and rested on and located above a rim of the lower support ring so that each of the hanging hooks is fixed on the lower support ring by the two outwardly extending resting plates and the first end of each of the hanging hooks;

the two outwardly extending resting plates of each of the hanging hooks are perpendicular to the first end of each of the hanging hooks.

2. The lamp shade in accordance with claim 1, wherein each of the locking members has a mediate portion formed with two outwardly extending resting plates located between the first end and the second of each of the locking members and rested on and located under a rim of the upper support ring so that each of the locking members is fixed on the upper support ring by the two outwardly extending resting plates and the first end of each of the locking members.

3. The lamp shade in accordance with claim 2, wherein the locking slot of each of the locking members is directed toward a direction perpendicular to that of the two outwardly extending resting plates.

4. The lamp shade in accordance with claim 2, wherein the two outwardly extending resting plates of each of the locking members are perpendicular to the first end of each of the locking members.

5. The lamp shade in accordance with claim 1, wherein each of the hanging hooks has a substantially C-shaped opening directed toward an inside of the lower support ring.

6. The lamp shade in accordance with claim 1, wherein the insertion portion of each of the support bars is slidably inserted into the locking slot of the respective locking member.

7. The lamp shade in accordance with claim 1, wherein the insertion portion of each of the support bars has a rectangular shape and has a width smaller than that of the first end of each of the support bars to facilitate insertion of the insertion portion of each of the support bars into the locking slot of the respective locking member.

8. The lamp shade in accordance with claim 1, wherein the hook hole of each of the support bars has a width greater than that of the respective hanging hook.

9. The lamp shade in accordance with claim 1, wherein the hook hole of each of the support bars is hooked on the bendable portion of the respective hanging hook.

10. The lamp shade in accordance with claim 9, wherein each of the hanging hooks has a substantially C-shaped opening directed toward an inside of the lower support ring.

11. The lamp shade in accordance with claim 10, wherein the bendable portion of the respective hanging hook is bendable after the hook hole of each of the support bars is hooked on the bendable portion of the respective hanging hook to close the opening to secure the second end of each of the support bars to the respective hanging hook.

12. The lamp shade in accordance with claim 10, wherein the insertion portion of each of the support bars is directly sideward slidable into the locking slot of the respective locking member from two opposite open sides of the locking slot of the respective locking member respectively.

13. The lamp shade in accordance with claim 10, wherein each of the support bars is located between the upper support ring and the lower support ring by the respective hanging hook and the respective locking member to support the shade body.

14. The lamp shade in accordance with claim 10, wherein each of the support bars is bendable so that the insertion portion of each of the support bars is inserted into the locking slot of the respective locking member.

15. The lamp shade in accordance with claim 10, wherein the shade body is made of a flexible material.

16. The lamp shade in accordance with claim 1, wherein the locking slot of each of the locking members is defined by two downward extending pieces which are spaced from each other.

* * * * *